US006626118B1

(12) United States Patent
Veit-Salomon et al.

(10) Patent No.: US 6,626,118 B1
(45) Date of Patent: Sep. 30, 2003

(54) CAR BODY WITH ROOF CLOSING PLATE AND TRANSVERSE ROOF ARCHES

(75) Inventors: Emil Veit-Salomon, Nürnberg (DE); Tobias Koch, Nürnberg (DE)

(73) Assignee: DaimlerChrysler Rail Systems GmbH (DE)

( * ) Notice: Subject to any disclaimer, the term of this patent is extended or adjusted under 35 U.S.C. 154(b) by 174 days.

(21) Appl. No.: 09/408,042

(22) Filed: Sep. 29, 1999

(30) Foreign Application Priority Data

Sep. 30, 1998 (DE) ..... 198 44 812

(51) Int. Cl.[7] ..... B61D 17/00; B60J 7/00
(52) U.S. Cl. ..... 105/396; 296/210
(58) Field of Search ..... 105/396, 397, 105/399; 296/210, 178, 179

(56) References Cited

U.S. PATENT DOCUMENTS 4,318,350 A * 3/1982 Skypala ..... 105/397
5,066,067 A * 11/1991 Ferdows ..... 296/197
5,259,322 A * 11/1993 Dominguez et al. ..... 105/4.1
5,934,739 A * 8/1999 Waldeck ..... 296/178

FOREIGN PATENT DOCUMENTS

DE 4306178 A1 9/1994
DE 19521192 A1 12/1996

* cited by examiner

*Primary Examiner*—S. Joseph Morano
*Assistant Examiner*—Robert J. McCarry, Jr.
(74) *Attorney, Agent, or Firm*—Webb Ziesenheim Logsdon Orkin & Hanson PC

(57) ABSTRACT

A car body 1 provided in particular for railway vehicles has two longitudinal roof beams 2 that support a roof closing plate 6 fastened to them in an air-tight and water-tight manner. Transverse roof arches 3 connect the longitudinal roof beams 2. To achieve a simplified structure, the transverse roof arches 3 are located above the roof closing plate 6, whereby auxiliary units 13 are installed on roof arches 3.

17 Claims, 1 Drawing Sheet

Fig 1
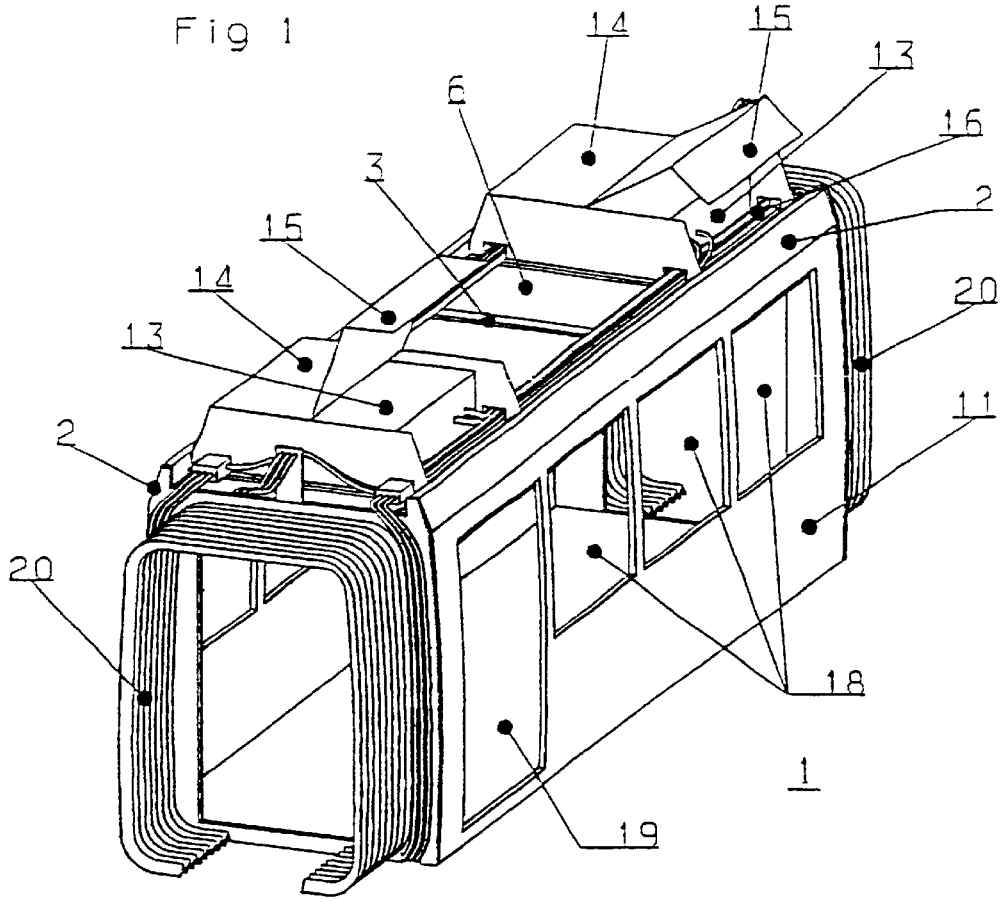
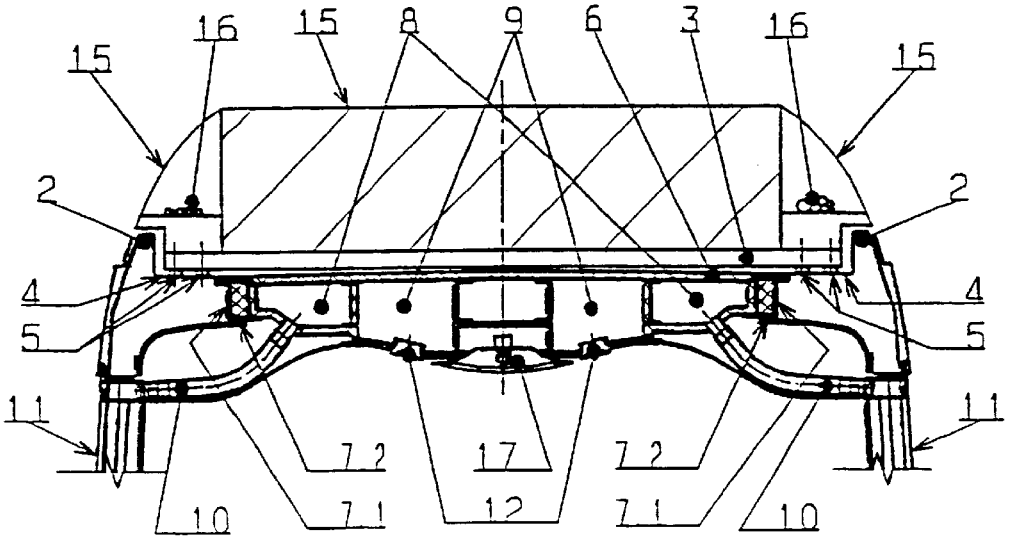
Fig 2

CAR BODY WITH ROOF CLOSING PLATE AND TRANSVERSE ROOF ARCHES

BACKGROUND OF THE INVENTION

1. Field of the Invention

This invention relates to a car body, in particular to railway vehicles.

2. Brief Description of the Prior Art

A similar car body of the prior art (DE 195 21 192 A1) has, in the vicinity of its long side walls, two longitudinal roof beams, between which a roof closing plate is fastened in a water-tight manner. The roof closing plate thereby supports the auxiliary units, and is supported by transverse roof arches that are located underneath the roof closing plate and extend from one longitudinal roof beam to the other.

The object of the invention is to apply measures to a car body by means of which the load on the roof closing plate can be reduced.

SUMMARY OF THE INVENTION

In one configuration of a car body as claimed by the invention, the roof closing plate is relieved of roof loads that occur as a result of the heavy auxiliary equipment units that are installed on the roof, such as the current collector, the air conditioning unit, control and regulation equipment, braking resistances, etc. The forces caused by these units are transmitted directly to the longitudinal roof beams via the outboard transverse roof arches. The roof closing plate can therefore be designed to absorb reduced loads, and can therefore be made lighter in weight. The displacement of the transverse roof arches outward also provides an opportunity for a more flexible internal configuration of the ceiling of the car body. No additional components are necessary, because the roof arches are merely displaced from the inside to the outside on the top of the car body. In addition to the auxiliary equipment, the roof arches also preferably support at least one body cover panel, whereby either one body cover panel covers all of the roof arches over at least most of their extent, or individual body cover panels are associated with different pieces of auxiliary equipment. The auxiliary equipment is straddled by the body cover panels, and is thus protected against the effects of weather, climate and other outside factors. It is also impossible for dirt to accumulate between the transverse roof arches. Each body cover panel is thereby provided each with a hatch that can be opened to provide access to the individual auxiliary units covered. It is also possible on at least some of the transverse roof arches to suspend the roof closing plate by means of suitable holders, so that the roof closing plate, for its part, is supported by the transverse roof arches and can therefore be realized in a lighter-weight construction, or can be isolated from extraordinary loads, for example if a person performing work in the vicinity of the roof or on the auxiliary equipment units steps between the transverse roof arches and thus on the roof closing plate.

The invention is explained in greater detail below with reference to the exemplary embodiment illustrated in the accompanying schematic diagrams.

BRIEF DESCRIPTION OF THE DRAWINGS

FIG. 1 shows a perspective view of a car body in the vicinity of the roof; and FIG. 2 is a transverse section through the roof area of the car body.

DETAILED DESCRIPTION OF THE PREFERRED EMBODIMENT

A car body for a streetcar, subway car or similar vehicle is equipped in its upper portion with two roof beams 2 that run in the longitudinal direction of the car body, and are firmly connected to one another by means of transverse roof arches 3 that run at right angles to them. The longitudinal roof beams 2 are equipped with horizontal support arms 4 that point toward the center of the car body, and on which the terminal segments of the transverse roof arches 3 sit. The fastenings are by means of tie rods, such as bolts or rivets, whereby between the respective support arm and the associated terminal segment of each transverse roof arch 3 there are two fastening rails 5 on the support arms 4.

Between the two longitudinal roof beams 2, below the transverse roof arch 3, a roof closing plate 6 is inserted that extends at least largely over the length of the car body 1 or of the longitudinal beam 2, and which is held air-tight and water-tight between the longitudinal beams 2. To hold the closing plate 6, the terminal sections of the longitudinal roof beams 2 that face one another are bent downward and then back toward the center of the car body. Between the vertical descending step flanks 7.1, the roof closing plate 6 is inserted air-tight and water-tight, while the step flanks 7.2 that are bent horizontally toward the center of the car body support the roof closing plate 6. The vertical dimension of the step flanks 7.1 is thereby used for the installation of hot air ducts 8 that run in the longitudinal direction of the car body and, like the fresh air ducts 9 that are adjacent to them toward the center, form an assembly with the roof cover plate 6. From the hot air ducts 8, feed lines 10 run to the side wall structures 11, in which there are ventilation ducts, in particular in the vicinity of windows 18. The side wall structures 11 thereby simultaneously support the longitudinal roof beams 2. In the wall of the fresh air ducts 9 lying against the interior of the car body 1 there are ventilation nozzles 12, through which fresh air is blown from the fresh air duct 9 into the interior of the car body. The ducts 8, 9 are thereby functionally connected with corresponding ventilation and air conditioning units, which are located in the form of an auxiliary unit 13 on the transverse roof arches 3. The auxiliary units 13 are protected against environmental factors either individually by body cover panels 14, whereby the body cover panels 14 sit on the transverse roof arches 3, or by the use of a body cover panel that covers all of the transverse roof arches 3 at least in large part, and covers all of the auxiliary units 13 that sit on the transverse roof arches 3. The respective body cover panels are equipped with hatch covers 15, the axis of rotation of which runs approximately in the longitudinal center axis of the car body and which, except for the top, also form at least one descending flank of the body cover panel. The electrical, hydraulic or pneumatic lines 16 that are required for the power supply, utilities, control and regulation systems of the auxiliary units and other equipment, such as, for example, the lighting system 17 in the interior of the car body, also run inside the body cover panels. Windows 18 and doors 19 are also provided in the side wall structures 11. Bellows 20 provided on the end of the car body are used for the connection between neighboring car bodies 1.

When a car body is constructed as claimed in the invention, after the installation of the roof closing plate 6, the system that consists of the transverse roof arches 3 and the auxiliary units 13 mounted on them, including the body cover panels, is placed as a unit on the longitudinal beam 2, and are fastened to the longitudinal roof beams 2 by means of suitable tie rods. High quality can thereby be achieved with significantly reduced costs and assembly times, because the assembly itself has been pre-assembled and inspected beforehand. If the roof closing plate 6 is also suspended from the transverse roof arches 3, the roof closing plate can be incorporated into the structural unit.

What is claimed is:

1. A car body with two longitudinal roof beams and a roof closing plate fastened to them air-tight and water-tight, and with transverse roof arches which are firmly connected on their ends to the longitudinal roof beams, wherein: the transverse roof arches are located above the roof closing plate; and auxiliary units are placed on the transverse roof arches; wherein the roof closing plate is self-supporting.

2. The car body as claimed in claim 1 wherein the roof closing plate supports at least one body cover panel.

3. The car body as claimed in claim 2 wherein the body cover panel has at least one hatch cover that can be opened.

4. The car body as claimed in claim 2 wherein the body cover panel substantially covers each of the transverse roof arches.

5. The car body as claimed in claim 2 wherein the body cover panel straddles the auxiliary units.

6. The car body as claimed in claim 2 wherein a body cover panel straddles an auxiliary unit.

7. The car body as claimed in claim 1 wherein the roof closing plate is suspended on the transverse roof arches.

8. The car body as claimed in claim 1 wherein the auxiliary unit is at least one of a braking resistance unit and an air conditioning unit.

9. The car body as claimed in claim 3 wherein the body cover panel substantially covers each of the transverse roof arches.

10. The car body as claimed in claim 3 wherein the body cover panel straddles the auxiliary units.

11. The car body as claimed in claim 4 wherein the body cover panel straddles the auxiliary units.

12. The car body as claimed in claim 3 wherein a body cover panel straddles an auxiliary unit.

13. The car body as claimed in claim 2 wherein the roof closing plate is suspended on the transverse roof arches.

14. The car body as claimed in claim 3 wherein the roof closing plate is suspended on the transverse roof arches.

15. The car body as claimed in claim 4 wherein the roof closing plate is suspended on the transverse roof arches.

16. The car body as claimed in claim 5 wherein the roof closing plate is suspended on the transverse roof arches.

17. The car body as claimed in claim 6 wherein the roof closing plate is suspended on the transverse roof arches.

* * * * *